US009306350B2

(12) United States Patent
Dalamiot

(10) Patent No.: US 9,306,350 B2
(45) Date of Patent: Apr. 5, 2016

(54) METHOD FOR CONVERTING A MALE CONNECTOR TO A FEMALE CONNECTOR AND CONVERTIBLE CONNECTOR

(71) Applicant: SOURIAU, Versailles (FR)

(72) Inventor: Jeremy Dalamiot, Duneau (FR)

(73) Assignee: SOURIAU, Versailles (FR)

( * ) Notice: Subject to any disclaimer, the term of this patent is extended or adjusted under 35 U.S.C. 154(b) by 158 days.

(21) Appl. No.: 14/011,733

(22) Filed: Aug. 27, 2013

(65) Prior Publication Data

US 2014/0065888 A1 Mar. 6, 2014

(30) Foreign Application Priority Data

Aug. 28, 2012 (FR) ..... 12 58049

(51) Int. Cl.

| | |
|---|---|
| ***H01R 25/00*** | (2006.01) |
| ***H01R 31/06*** | (2006.01) |
| ***H01R 43/20*** | (2006.01) |
| ***H01R 43/26*** | (2006.01) |

(52) U.S. Cl.

CPC ..... *H01R 25/00* (2013.01); *H01R 31/06* (2013.01); *H01R 43/20* (2013.01); *H01R 43/26* (2013.01); *Y10T 29/49218* (2015.01)

(58) Field of Classification Search

CPC ..... H01R 25/00; H01R 43/26; H01R 27/00; H01R 31/06

USPC ..... 439/654, 638

See application file for complete search history.

(56) References Cited

U.S. PATENT DOCUMENTS

| | | | | |
|---|---|---|---|---|
| 3,017,603 | A * | 1/1962 | Bac | 439/314 |
| 4,010,993 | A * | 3/1977 | Hohenberger et al. | 439/176 |
| 4,728,163 | A * | 3/1988 | Kittinger et al. | 439/172 |
| 5,226,724 | A * | 7/1993 | Kanarek | 362/260 |
| 5,324,209 | A * | 6/1994 | Falossi et al. | 439/362 |
| 5,575,690 | A * | 11/1996 | Eaton | 439/717 |
| 6,099,332 | A * | 8/2000 | Troyan | 439/176 |
| 6,250,961 | B1 | 6/2001 | Boiret et al. | |
| 6,319,073 | B1 | 11/2001 | Menolotto et al. | |
| 7,250,977 | B2 * | 7/2007 | Silverbrook et al. | 439/507 |
| 2009/0197447 | A1 * | 8/2009 | Maeland | 439/191 |

FOREIGN PATENT DOCUMENTS

| | | |
|---|---|---|
| EP | 0150556 A2 | 8/1985 |
| EP | 0206722 A1 | 12/1986 |
| FR | 2783099 A1 | 3/2000 |

* cited by examiner

*Primary Examiner* — Briggitte R Hammond

(74) *Attorney, Agent, or Firm* — IM IP Law PLLC; C. Andrew Im

(57) ABSTRACT

A method for converting a male connector to a female connector. A connector comprising a header, an insert and a female adapter module. The header is equipped with a plurality of pins forming male contacts. The insert ensures the hermeticity of the male pins in the header. The female adapter module is mounted in the header so as to form a female connector. The female adapter module comprises a plurality of sockets forming female contacts. Each female socket is mounted around a male pin, and a locking housing is mounted around the plurality of sockets so as to tighten each female socket around the associated male pin.

10 Claims, 3 Drawing Sheets

METHOD FOR CONVERTING A MALE CONNECTOR TO A FEMALE CONNECTOR AND CONVERTIBLE CONNECTOR

RELATED APPLICATIONS

This application claims priority from French Patent Application No. 12 58049 filed Aug. 28, 2012, which is incorporated herein by reference in its entirety.

FIELD OF THE INVENTION

The invention relates to a method for converting a male connector to a female connector. The invention also relates to a male connector capable of being converted to a female connector.

The invention has applications in the field of aeronautic connectors, the field of automotive connectors, and in general, in all connector fields using male and female connectors.

PRIOR ART

Currently, in the connector field, there are male connectors, i.e. connectors with male electrical contacts, made to receive a complementary connector with female contacts. There are also female connectors, i.e. with female electrical contacts, made to receive complementary connectors with male contacts. Each connector is therefore a specific type of connector, either female or male.

Male connectors comprise an insert in which are housed one or more pins forming the male electrical contact. An example of a conventional male connector is shown, in a sectional view, in FIG. 1. This male connector, referenced 1, comprises a header 11 inside which is disposed a plurality of male contact pins 10, called male pins. These pins 10 are held in an insert 13, which ensures the impermeability of said contacts inside the connector. In certain types of male connectors, the insert is a glass insert, i.e. a glass bead fused at high temperature so that it surrounds the male contacts, thus sealing them inside the connector. An interfacial seal 14 is generally installed on the insert 13, around the male pins, and ensures the impermeability of said pins.

A mating seal 12 ensures the impermeability of the male connector with the female counterpart when the two elements are connected.

Female connectors generally comprise an insert in which are housed one or more sockets forming the female electrical contacts. An example of a conventional female connector is shown in FIG. 2 in a sectional view. This female connector is a connector in the same range as the male connector of FIG. 1. This female connector, referenced 2, comprises an insert 21 inside which is housed a plurality of female contact sockets 20, called female sockets. A mating seal 22 ensures the impermeability of the insert. In this type of female connector, no interfacial seal is necessary, since the sockets are embedded into the insert.

As is clear from these FIGS. 1 and 2, the male connector and the female connector are separate connectors, each adapted to be connected to a complementary connector. The male connector of FIG. 1 is adapted to receive a complementary female connector and the female connector of FIG. 2 is adapted to receive a complementary male connector.

During the installation of an electrical device in an electrical system or a connection system, the operator performing this installation must have on hand the appropriate type of connector for the electrical device. He must therefore know, prior to installing the device, whether he will need a male connector or a female connector to connect the device to the system. During certain installations, particularly large installations requiring a large number of connectors to be installed, the operator cannot always know the exact number of connectors of each type he will need in order to perform the full installation.

Currently, if the operator does not know the exact number of connectors of each type he will need, he is obligated to return to the store to shop for complementary connectors or to exchange a connector of one type for a connector of another type. It is understood that the time required for the exchange results in an additional labor cost.

When the installation is in a harsh environment or in a place that is difficult to access, the operator generally prefers to carry a large number of connectors of each type in order to have a sufficient number of connectors in his possession to avoid having to return to the store. In that case, some of these connectors will necessarily remain unused. It is clear that, in that case, the purchase of unused connectors results in an unnecessary materials cost.

SUMMARY OF THE INVENTION

The object of the invention is precisely to overcome the drawbacks of the conventional techniques described above. Thus, the invention proposes a method for converting a male connector to a female connector. The male connector is converted to a female connector by adding, to a conventional male connector, a female adapter module adapted to be mounted inside the male connector. Thus, the operator in charge of the connector installation can purchase and carry the number of male connectors that corresponds exactly to the number of connectors required, to which he can add female adapter modules as required for the installation.

Such a male connector that is convertible to a female connector has the advantage of facilitating materials management by the operator. In essence, the operator need only have male connectors with female adapter modules in his possession, and convert one or more male connectors into female connectors as needed. The conversion method is simple to implement since it consists of inserting the female adapter module into the male connector and press-fitting it into place.

More precisely, the invention relates to a method for converting a male connector to a female connector, the male connector comprising a header equipped with a plurality of male pins and an insert ensuring the hermeticity of the male pins in the header. The method includes the following operations:

- installing a plurality of female contact sockets, a female socket being mounted around each male pin of the male connector,
- installing a locking housing around the plurality of sockets, and
- press-fitting the locking housing around the plurality of sockets so as to tighten each female socket around the associated male pin.

This method may comprise one or more of the following features:

- the press-fitting of the locking housing consists of pressing the locking housing into the header until a deformation zone of each socket is deformed.
- it consists of installing an interfacial seal between the insert and the locking housing in order to protect said insert and ensure an impermeability of the connector.

The invention also relates to a connector comprising a header equipped with a plurality of pins forming male contacts and with an insert ensuring the hermeticity of said male pins in the header. This connector is characterized in that it comprises a female adapter module capable of being mounted into the header so as to form a female connector, said female adapter module comprising:

- a plurality of sockets forming female contacts, each female socket being adapted to be mounted around a male pin, and
- a locking housing capable of being mounted around the plurality of sockets so as to tighten each female socket around the associated male pin.

This connector may comprise one or more of the following features:

- each socket comprises a front zone comprising a socket tube capable of ensuring an electrical connection with a complementary male connector and a rear zone adapted for being positioned around a male pin and comprising a deformation zone capable of being deformed during the press-fitting of the locking housing so as to apply pressure to the rear zone of the female socket around the male pin.
- the deformation zone of the female socket comprises a cylindrical inner structure equipped with two radial disks separated by a compressible intermediate zone, ensuring a longitudinal deformation of the female socket during the press-fitting of the locking housing.
- the deformation zone of the socket comprises two parallel shoulders and a lateral opening between the two shoulders, ensuring a radial deformation of the female socket during the press-fitting of the locking housing.
- the locking housing comprises an insulating layer and a rear wafer forming a receptacle block comprising a plurality of receptacles, each made to receive a female socket, the rear wafer being disposed around the deformation zone of the female sockets so as to ensure the deformation of said deformation zone of each female socket.
- each receptacle of the receptacle block is equipped with a retaining means capable of retaining the female socket inside the receptacle.

In one embodiment of the invention, the insert is a glass bead. In that case, the locking housing includes an interfacial seal positioned between the glass bead and the locking housing to ensure impermeability between the contacts of the connector.

DETAILED DESCRIPTION OF EMBODIMENTS OF THE INVENTION

The invention relates to a method for converting a conventional male connector, as described in connection with FIG. 1, into a female connector capable of receiving a complementary male connector. Thus, the method of the invention proposes to insert, into a conventional male connector, a female adapter module. This female adapter module comprises a plurality of sockets, each capable of being mounted around a male pin. The female adapter module also comprises a locking housing adapted for being installed in the male connector, around the sockets, so as to apply pressure to the sockets around the male pins. The male connector thus converted corresponds to a female connector having functions identical to those of the female connector of FIG. 2. This converted male connector can therefore receive a complementary male connector.

Figure 3:
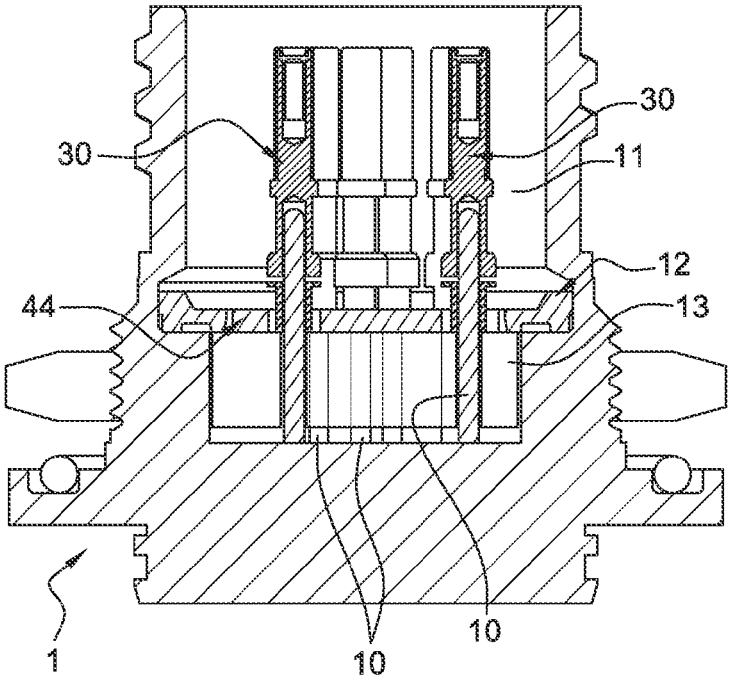
FIG. 3 shows a connector according to the invention in which the sockets of the female adapter module are installed.
Figure 4:
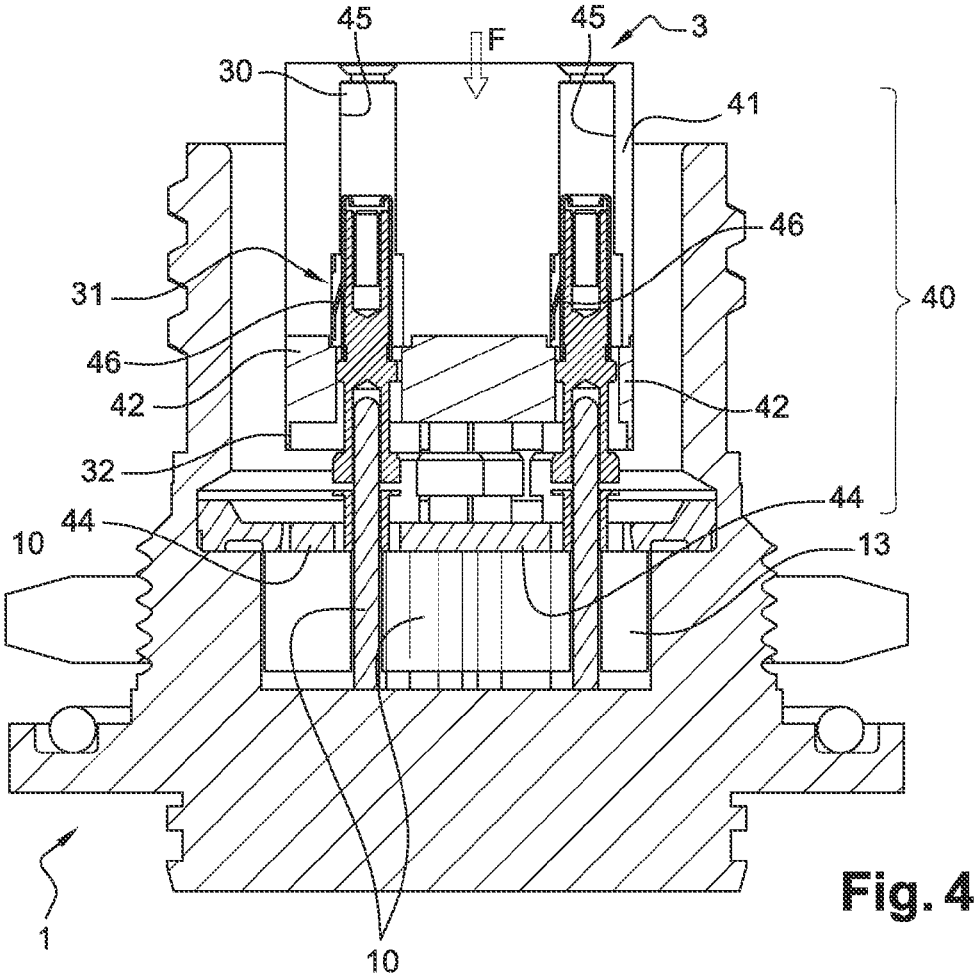
FIG. 4 shows a connector according to the invention when the locking housing is in the process of being installed.

The convertible male connector of the invention is shown in a sectional view in FIGS. 3 and 4. More precisely, FIG. 3 shows the convertible male connector as the female sockets are installed on the male pins. FIG. 4 shows the convertible male connector when the locking housing is installed around the female sockets.

Figure 1:
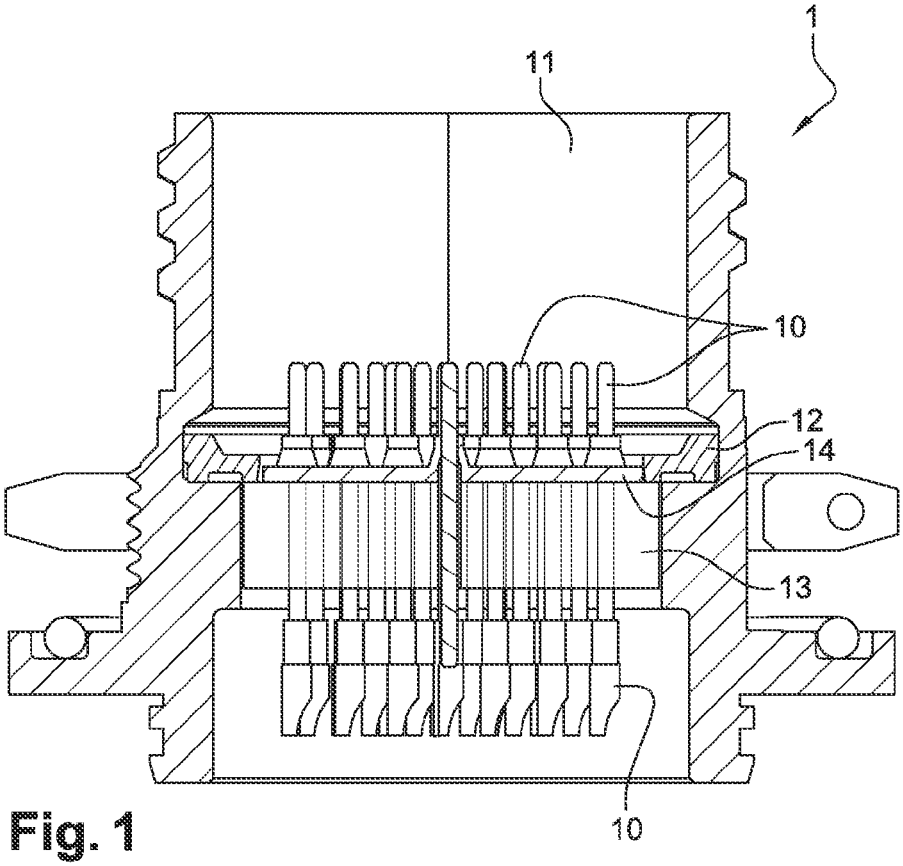
FIG. 1, described above, shows a conventional male connector.
Figure 2:
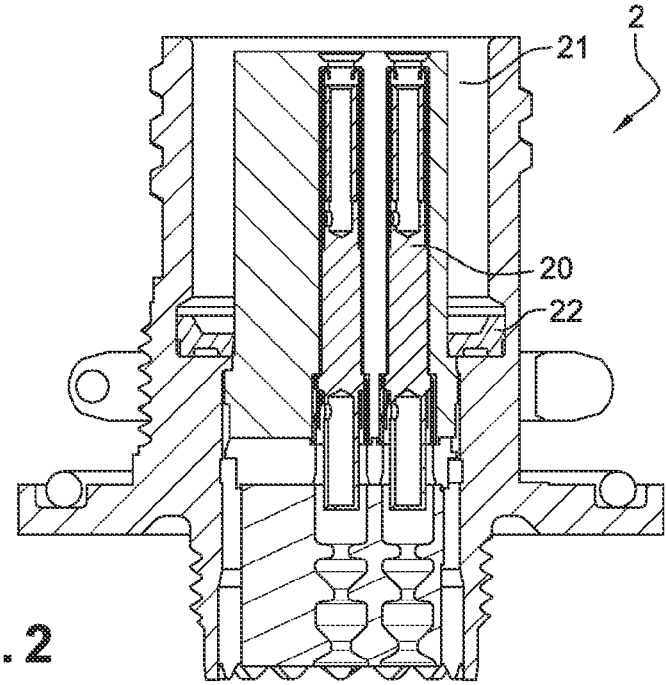
FIG. 2, described above, shows a female connector in the same range as the male connector of FIG. 1.

As shown in FIGS. 3 and 4, the convertible male connector comprises a male connector 1 identical to a conventional male connector like the one shown in FIG. 1. This male connector 1 thus comprises a header 11, male pins 10 and an insert 13.

The convertible connector of the invention also comprises a female adapter module 3. This female adapter module 3 comprises a plurality of female sockets 30. Each of these female sockets 30 is mounted around one of the male pins 10. The convertible connector therefore comprises as many female sockets as male pins. In FIG. 3, only two female sockets 30 are shown in cross-section, the other female sockets 30 being shown in a front view.

The female adapter module 3 of the invention also comprises a locking housing 40 adapted to be mounted into the header 11 and for fitting around the female sockets 30. The installation of this locking housing 40 around the female sockets 30 is shown in FIG. 4. In this FIG. 4, only two female sockets 30 and two male pins 10 are shown in cross-section, the other male pins 10 and female sockets 30 being shown in a front view.

As shown in FIGS. 3 and 4, the installation of the female adapter module 3 is performed as follows: a female socket 30 is installed around each male pin 10. The locking housing 40 is then installed in the header 11 so as to surround each of the sockets 30. A pressure on the locking housing 40, indicated by the arrow F, ensures the fitting of said locking housing into the header and the mounting of the female sockets 30 around the male pins 10.

In order to be fitted into the header 11 and to ensure the mounting of the female sockets 30, the locking housing 40 comprises several elements forming a receptacle block. This receptacle block comprises a plurality of receptacles 45, each receptacle having a shape adapted to internally receive a female socket 30. Each female socket 30 thus passes all the way through the locking housing 40.

More precisely, the locking housing 40 comprises a rear wafer 42 that is fitted around the rear part 32 of each female socket 30, i.e. the part surrounding the male pin 10. The locking housing 40 also comprises an insulating layer 41, made of insulating material, surmounting the rear wafer 42 and surrounding the front part 31 of the female sockets 30. This insulating layer 41 protects and retains the front part of the female sockets 30 inside the male connector 1.

The rear wafer 42 is made from a material that is substantially more elastic than that of the insulating layer. Thus, the diameter of the receptacles is slightly smaller in the rear wafer 42 than in the insulating layer 41.

The insulating layer 41 closes the front part of the convertible connector, giving said convertible connector an outer shape identical to the outer shape of a conventional female connector. Thus, a complementary male connector can be mounted inside the convertible connector as though it were a female connector.

In one embodiment of the invention, the male connector 1 comprises a glass insert, called a glass bead. In that case, the locking housing 40 can include an interfacial seal 44 installed after the rear wafer 42 so that it is positioned on the glass insert of the male connector when the female adapter module 3 is installed. This interfacial seal 44 is thus able to protect the glass insert and ensure impermeability between the contacts of the converted connector.

Means for retaining the female sockets are mounted inside each receptacle 45 of the locking housing 40. These retaining means 46 are made to hold the female sockets 30 in place inside the receptacles 45 of the locking housing. These retaining means 46 can be, for example, a clip mounted on the rear wafer 42, inside each receptacle, for clipping each female socket into the insulating layer 41. In that case, the inner structure 35 of the female socket comprises a radial disk forming a stop 47. When the locking housing is fitted around the female socket 30, the clip 46 comes to rest against the stop 47, holding the locking housing in place around the female sockets 30.

Thus, in the invention, the retention of the female adapter module 3 inside the male connector 1 is obtained simply by fastening by means of the clips 46, and by compression; no soldering operation is necessary.

Figure 5:
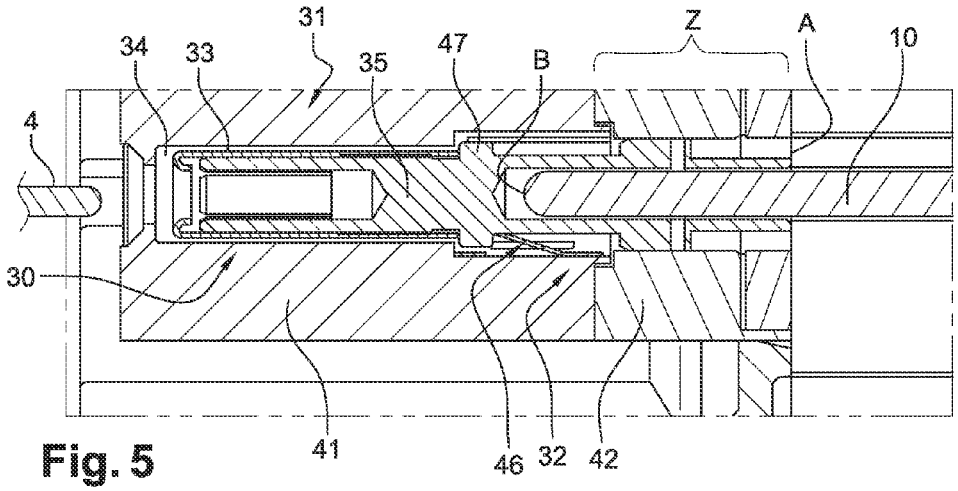
FIG. 5 shows a partial view of the connector of 4 when the female adapter module is mounted inside the connector.

FIG. 5 shows a sectional view of a female socket 30 mounted inside the locking housing 40, around a male pin 10, all of the sockets of the convertible connector being identical. This socket 30 comprises a front part 31 (or front zone) and a rear part 32 (or rear zone). The front part 31 is identical to the front part of a conventional female connector socket; it comprises a socket tube 33 clipped to the inside of a socket body 34 and made to receive, and to ensure an electrical connection with, a male pin of a complementary connector 4.

Figure 6:
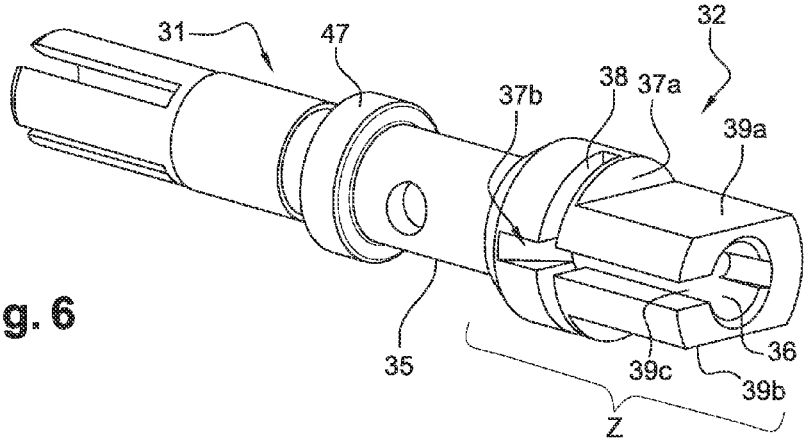
FIG. 6 shows a perspective view of a socket of the female adapter module of the invention.
Figure 7:
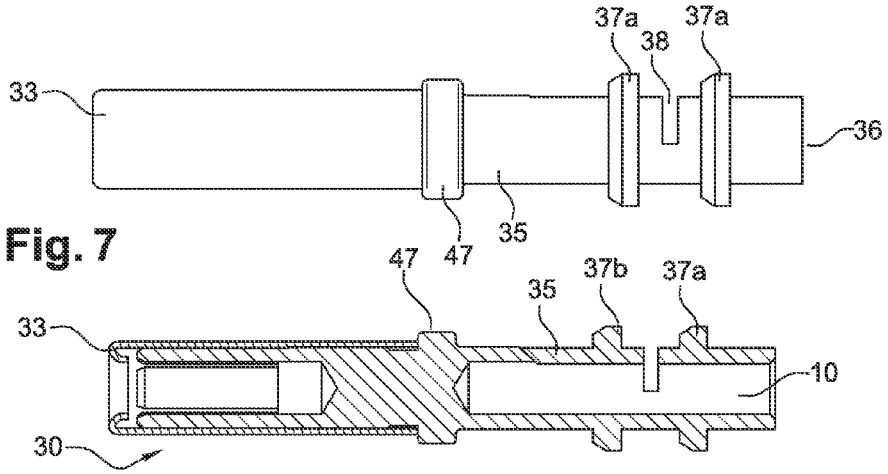
FIG. 7 shows a side view and a sectional view of the socket of the female adapter module of the invention.

The rear part 32 of the female socket 30 is adapted to the invention and is capable of being deformed. Thus, the rear part 32 of the socket has a partially deformable inner structure 35. The deformable part of the inner structure 35 is called the deformation zone Z. This inner structure 35, shown in detail in FIGS. 6 and 7, extends from the rear end A of the socket to the socket tube 33 of the front part 31. In the front part 31 of the socket, the inner structure 35 is identical to the inner structure of a conventional female socket with a substantially cylindrical shape capable of being inserted into the socket tube 33.

In the deformation zone Z, the inner structure 35 has a substantially cylindrical and hollow shape, with a recess 36 with dimensions adapted to the dimensions of the male pins. The rear part 32 of the female socket is thus capable of receiving a male pin. The inner wall of the recess 36 is covered, at least at its closed end B, with a layer of electrically conductive material, thus ensuring electrical continuity with the male pin. The rear part 32 of the socket can therefore be slid over the male pin 10 until said pin is in contact with the closed end B of the recess 36.

The inner structure 35, in the rear part 32 of the socket 30, is deformable. Thus, it includes two radial disks 37*a*, 37*b* parallel to each other and separated by a compressible intermediate zone 38. In this intermediate zone 38, the inner structure 35 is only semi-circular, so as to constitute a weakness in the structure, which can produce a longitudinal deformation of the female socket 30 when pressure is applied. The inner structure 35 also comprises, at its end A, two parallel flat areas 39*a* and 39*b*, on opposite sides from each other, and a lateral opening 39*c* between these shoulders. This lateral opening 39*c* can extend through the radial disks 37*a*, 37*b*. This lateral opening 39*c* and these shoulders 39*a* and 39*b* constitute a radial deformation zone of the inner structure 35.

Thus, when the locking housing 40 is inserted around the female sockets 30, press-fitting said locking housing into the header 11 makes it possible to deform the inner structure 35 so as to compress the male pin. Essentially, during the press-fitting of the locking housing, the passage of the radial disks 37*a*, 37*b* from the insulating layer 41 into the rear wafer 42 has the effect of deforming the deformation zone of the inner structure 35. This deformation of the inner structure 35 comprises:

- a compression of the intermediate zone 38 between the radial disks 37*a* and 37*b*, which makes it possible to ensure the electrical contact between the male pin and the closed end B of the recess 36, and
- a radial compression of the inner structure in its rear part surrounding the male pin, which makes it possible to seal the female socket around said male pin.

This longitudinal and radial deformation of the inner structure 35 keeps the protective layer covering the male pins intact, thereby ensuring good electrical continuity and good corrosion resistance between the male connector and the female adapter module.

The invention claimed is:

1. Method for converting a male connector to a female connector, the male connector comprising a header equipped with a plurality of male pins and an insert ensuring the hermeticity of the male pins in the header, the method comprising the steps of:

installing a plurality of female contact sockets around the male pins of the male connector, a female contact socket being mounted around each male pin of said male connector, each female contact socket comprising:

a front zone comprising a socket tube capable of ensuring an electrical connection with a complementary male connector; and a rear zone configured to be positioned around a male pin and comprising a deformation zone configured to be deformed during the press-fitting of the locking housing to apply pressure to the rear zone of said each female contact socket around the associated male pin, the deformation zone of said each female contact socket comprises a cylindrical inner structure equipped with two radial disks separated by a compressible intermediate zone, ensuring a longitudinal deformation of said each female contact socket during the press-fitting of the locking housing;

installing a locking housing in a header of the male connector, around the plurality of female contact sockets, and press-fitting the locking housing into the header to tighten said each female contact socket around the associated male pin by deforming an inner structure of a rear part of said each female contact socket.

2. Method according to claim 1, further comprising the step of installing an interfacial seal between the insert and the locking housing in order to protect said insert and ensure an impermeability of the connector.

3. Connector comprising a header equipped with a plurality of pins forming male contacts and with an insert ensuring the hermeticity of said male pins in the header, the connector comprising a female adapter module capable of being mounted in the header so as to form a female connector, said female adapter module comprising:

a plurality of sockets forming female contacts, each female socket being adapted to be mounted around a male pin, and a locking housing capable of being mounted around the plurality of sockets so as to tighten each female socket around the associated male pin, said each female socket comprising:

a front zone comprising a socket tube capable of ensuring an electrical connection with a complementary male connector, and a rear zone configured to be positioned around a male pin and comprising a deformation zone configured to be deformed during the press-fitting of the locking housing to apply pressure to the rear zone of said each female socket around the associated male pin, the deformation zone of said each female socket comprises a cylindrical inner structure equipped with two radial disks separated by a compressible intermediate zone, ensuring a longitudinal deformation of said each female socket during the press-fitting of the locking housing.

4. Connector comprising a header equipped with a plurality of pins forming male contacts and with an insert ensuring the hermeticity of said male pins in the header, the connector comprising a female adapter module capable of being mounted in the header so as to form a female connector, said female adapter module comprising:

a plurality of sockets forming female contacts, each female socket being adapted to be mounted around a male pin, and a locking housing capable of being mounted around the plurality of sockets so as to tighten each female socket around the associated male pin, said each female socket comprising:

a front zone comprising a socket tube capable of ensuring an electrical connection with a complementary male connector, and a rear zone configured to be positioned around a male pin and comprising a deformation zone configured to be deformed during the press-fitting of the locking housing to apply pressure to the rear zone of said each female socket around the associated male pin, the deformation zone of the socket comprises two parallel shoulders and a lateral opening between the two shoulders, ensuring a radial deformation of said each female socket during the press-fitting of the locking housing.

5. Connector according to claim 3, wherein the locking housing comprises an insulating layer and a rear wafer forming a receptacle block comprising a plurality of receptacles, each made to receive a female socket, the rear wafer being disposed around the deformation zone of the female sockets so as to ensure the deformation of said deformation zone of each female socket.

6. Connector according to claim 5, wherein each receptacle of the receptacle block is equipped with a retaining means capable of retaining the female socket inside the receptacle.

7. Connector according to claim 3, wherein the insert is a glass bead, and wherein the locking housing comprises an interfacial seal positioned between the glass bead and the locking housing to ensure the impermeability of the connector.

8. Connector according to claim 4, wherein the locking housing comprises an insulating layer and a rear wafer forming a receptacle block comprising a plurality of receptacles, each made to receive a female socket, the rear wafer being disposed around the deformation zone of the female sockets so as to ensure the deformation of said deformation zone of each female socket.

9. Connector according to claim 8, wherein each receptacle of the receptacle block is equipped with a retaining means capable of retaining the female socket inside the receptacle.

10. Connector according to claim 4, wherein the insert is a glass bead, and wherein the locking housing comprises an interfacial seal positioned between the glass bead and the locking housing to ensure the impermeability of the connector.

* * * * *